United States Patent [19]

Barnes et al.

[11] Patent Number: 4,839,781

[45] Date of Patent: Jun. 13, 1989

[54] REFLECTOR/REFRACTOR

[75] Inventors: Josh T. Barnes, Charlevoix; Ronald L. Sitzema, Jr., Ellsworth, both of Mich.

[73] Assignee: Lexalite International Corporation, Charlevoix, Mich.

[21] Appl. No.: 209,525

[22] Filed: Jun. 21, 1988

Related U.S. Application Data

[63] Continuation-in-part of Ser. No. 181,184, Apr. 13, 1988.

[51] Int. Cl.[4] ..... F21V 7/07; F21V 5/02

[52] U.S. Cl. ..... 362/299; 362/285; 362/309; 362/311; 362/327; 362/337; 362/340; 362/360; 362/361; 350/167

[58] Field of Search ..... 362/285, 286, 287, 297, 362/299, 307, 308, 309, 311, 327, 335–337, 340, 360, 361; 350/167

[56] References Cited

U.S. PATENT DOCUMENTS

| | | | |
|---|---|---|---|
| 563,836 | 7/1896 | Blondel et al. | 62/334 |
| 1,447,500 | 3/1923 | Ainsworth | 362/307 |
| 2,209,929 | 2/1936 | Luce | 362/307 |
| 2,566,126 | 8/1951 | Franck | 362/309 |
| 2,686,255 | 8/1954 | Pascucci | 362/361 |
| 3,089,024 | 5/1963 | Odle | 362/309 |
| 3,160,350 | 12/1964 | Rex et al. | 362/340 |
| 3,233,140 | 11/1966 | Rex | 315/12.1 |
| 3,384,743 | 5/1968 | Little et al. | 362/309 |
| 3,398,273 | 8/1968 | Rex et al. | 362/309 |
| 3,398,274 | 8/1968 | Rex | 362/348 |
| 4,173,037 | 10/1979 | Henderson, Jr. et al. | 362/285 |
| 4,563,730 | 1/1986 | Saito | 362/307 |
| 4,683,525 | 7/1987 | Camm | 362/297 |

*Primary Examiner*—Ira S. Lazarus
*Assistant Examiner*—David G. Messer
*Attorney, Agent, or Firm*—Mason, Kolehmainen, Rathburn & Wyss

[57] ABSTRACT

A reflector/refractor device is provided for use with a variety of lighting fixtures and light sources. The reflector/refractor device includes a body having a predetermined profile and defining a cavity with the body having an inside surface and an outside surface. An illuminating source for emitting light is disposed within the cavity substantially along a central vertical axis of the body. The body includes a series of sectional zones for reflecting and refracting light. The exterior surface of the device includes a plurality of substantially vertical prisms consisting of reflective elements, refractive elements and elements that may be either reflective or refractive depending on light center location. These reflective or refractive elements act in combination to selectively vary light distribution characteristics of vertical and lateral angles, and intensities, by vertical displacement of the illuminating lamp source.

20 Claims, 8 Drawing Sheets

REFLECTOR/REFRACTOR

RELATED APPLICATION

This application is a continuation-in-part of Ser. No. 181,184 filed Apr. 13, 1988 pending.

BACKGROUND OF THE INVENTION

The present invention relates to reflectors and more particularly, to a reflector device used with lighting fixtures.

Various known reflector devices are used for commercial, industrial, institutional and residential lighting fixtures. Conventional reflectors are designed and constructed to provide a desired lighting distribution for a particular application. The conventional reflector provides the desired light distribution either by opaque reflective surfaces which provide no transmitted rays, by internal prismatic reflection through basic 90 degree surface prisms, or by some combination of these that are arranged for a single particular type of light source at a single light source position.

It is desirable to provide a device with a unique optical system further defined as a reflector/refractor adapted for use with a broad range of lamp types and sizes. It is further desirable to provide such a reflector/-refractor that is able to achieve a range of lighting distribution characteristics suitable for various applications and without requiring modification or any special or additional reflectors or refractors. It is further desirable to reduce the sharp, bright/dark contrast line and apparent brightness resulting in many of the conventional reflectors referred to above.

SUMMARY OF THE INVENTION

Among the important objects of the present invention are to provide a reflector/refractor device for use with a lighting fixture, to provide such reflector/refractor device for use with a broad range of lamp types and sizes, to provide such reflector/refractor that provides a range of light distribution characteristics suitable for various applications, and to provide such reflector/refractor device selectively providing such reflector/refractor device selectively providing a predetermined light distribution characteristic by a vertical movement of an illuminating lamp source, and to provide a reflector/refractor device that overcomes many of the disadvantages of the prior art reflector devices specifically including brightness and excessive contrast.

In brief, in accordance with the above and other objects of the recent invention, there is provided a reflector/refractor device used with a lighting fixture including a body having a predetermined profile and defining a cavity with the body having an inside surface and an outside surface. An illuminating source for emitting light is disposed within the cavity substantially along a central vertical axis of the body. The body includes a series of sectional zones for reflecting and refracting light. Each of the sectional zones has predetermined light distribution characteristics and at least one of the sectional zones has predetermined light distribution characteristics that are selectively variable by a vertical movement of the illuminating lamp source.

BRIEF DESCRIPTION OF THE DRAWING

The present invention and its objects and advantages may be better understood from consideration of the following detailed description of the preferred embodiment of the invention illustrated in the accompanying drawings in which.

DETAILED DESCRIPTION OF THE PREFERRED EMBODIMENT

Figure 1:
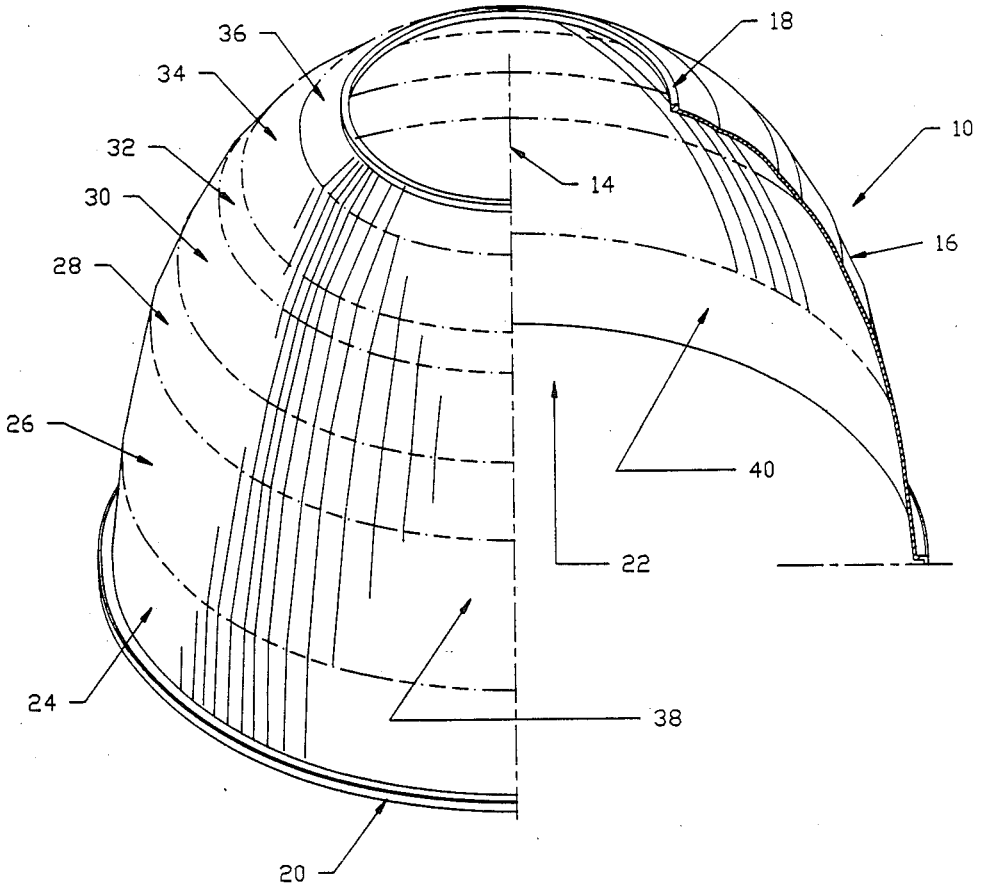
FIG. 1 is an isometric view, partly broken away, of a reflector/refractor device constructed in accordance with the invention.
Figure 2:
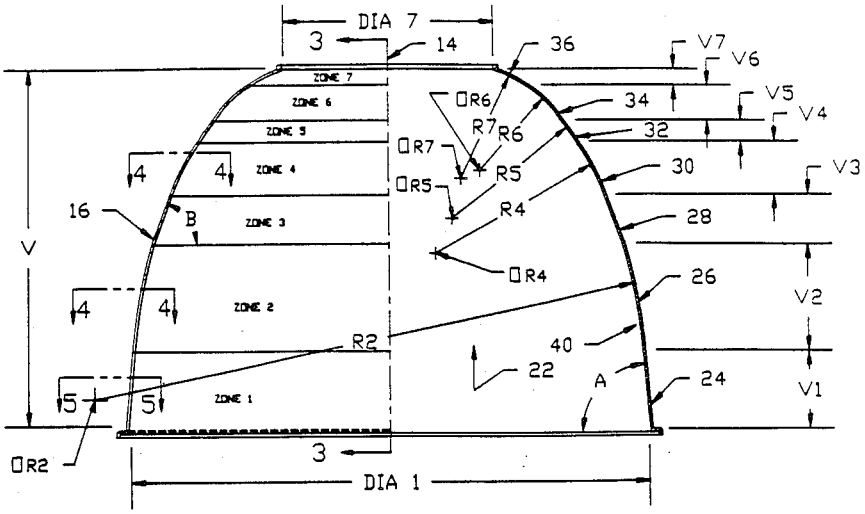
FIG. 2 is a side elevational view of the reflector/refractor device of FIG. 1 with one half shown in cross-section.
Figure 3:
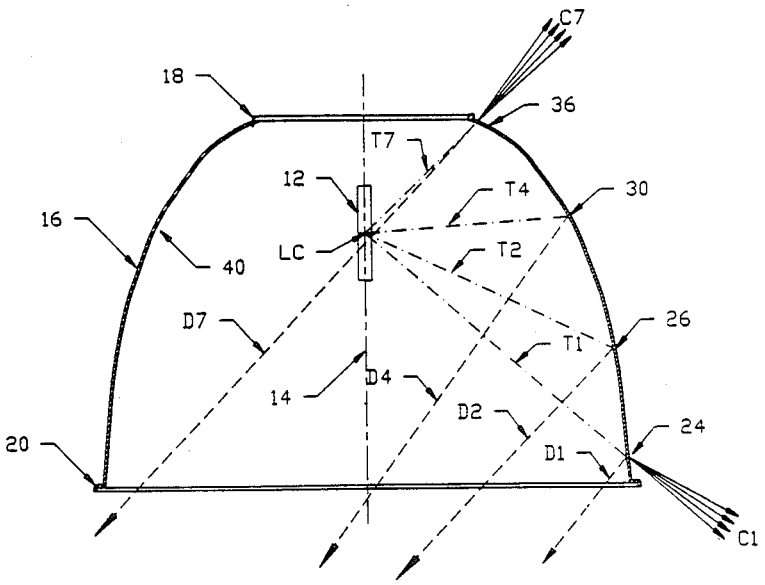
FIG. 3 is a vertical cross-sectional view taken along the line 3—3 of FIG. 2 and showing a typical light source location.

Referring initially to FIGS. 1–3, there is shown a reflector/refractor device constructed in accordance with the principles of the present invention and designated as a whole by the reference character 10. An illumination source or lamp 12 is disposed along a central vertical axis 14 of the reflector/refractor 10. A high intensity discharge lamp, such as, for example, a high pressure sodium, metal halide or mercury vapor lamp can be used for the light source 12, although various other commercially available lamps can be employed.

The reflector/refractor device 10 includes a unitary body 16 having an upper rim 18 and a lower rim 20. The body 16 defines a interior cavity 22. The lamp 12 is selectively vertically positioned within the cavity 22 substantially along the central vertical axis 14 to provide a desired light distribution characteristic for a particular application.

Figure 7A:
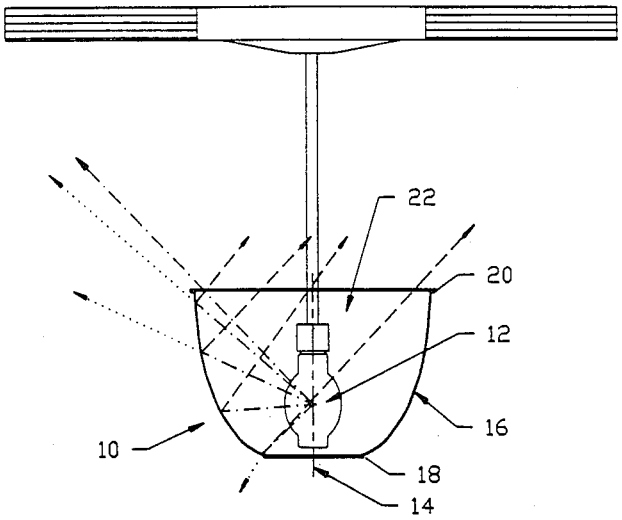
FIGS. 7A and 7B, are vertical cross-sectional views of an inverted reflector/refractor device of FIG. 1 illustrating indirect lighting applications.
Figure 7B:
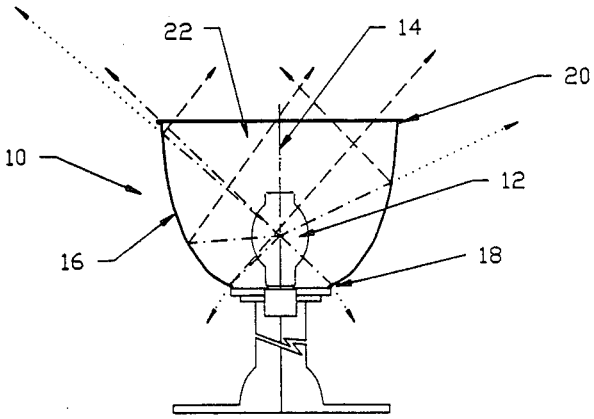

The reflector/refractor body 16 has a predetermined profile generally shaped as an inverted bowl to provide for direct lighting applications as shown in FIGS. 1–3. FIGS. 7A and 7B illustrate the reflector/refractor 10 with an inverted orientation or an upright bowl-shaped profile utilized for indirect lighting applications.

A series of sectional zones designated generally as 24, 26, 28, 30, 32, 34 and 36 and labelled as zones 1–7 in FIG. 2 together define the generally bowl-shaped profile of the body 16. Sectional zones 24 and 28 are frustro-conical segments formed at an angle labelled A and B, respectively, in FIG. 2. Sectional zones 24 and 28 have a vertical dimension or height illustrated by an arrow labelled as V1 and V3, respectively. Sectional zones 26, 30, 32, 34 and 36 are frustro-toroidal segments having a vertical dimension indicated by the reference characters V2, V4, V5, V6 and V7, respectively.

FIGS. 3, 7A and 7B include a plurality of light path traces to generally illustrate typical light ray redirection by the sectional zones of the reflector/refractor 10. Referring to FIG. 3, a plurality of light path traces T1, T2, T4 and T7 are shown extending from a central point LC of the lamp 12 to respective points within the sectional zones 24, 26, 30 and 36. Light path traces T1 and T7 provide a respective refracted component C1 and C7. Each of the light path traces T1, T2, T4 and T7 provide a respective reflected component D1, D2, D4 and D7.

Referring to FIG. 2, each of the frustrotoroidal sectional zones 26, 30, 32, 34, and 36 has a predetermined radius R2, R4, R5, R6, and R7, respectively. An origin of each respective radius R2, R4, R5, R6 and R7 is appropriately offset from the vertical axis 14 and in a sectional zone as shown in FIG. 2 to provide the generally bowl-shaped profile of the body 16.

An origin OR2 of the radius R2 for the frustro-toroidal sectional zone 26 is disposed outside the cavity 22 in the level of sectional zone 24. An origin OR4 of the radius R4 for the frustro-toroidal sectional zone 30 is disposed within the cavity 22 in the level of sectional zone 26. An original OR5 of the radius R5 for the frustro-toroidal sectional zone 32 is disposed within the cavity 22 in the level of sectional zone 28. An origin OR6 of the radius R6 for the frustro-toroidal sectional zone 34 is disposed within the cavity 22 in the level of sectional zone 30. An origin OR7 of the radius R7 for the frustro-toroidal sectional zone 36 is disposed within the cavity 22 in the level of sectional zone 30.

An inside diameter of zone 24 at the lower perimeter of body 16 is illustrated by an arrow DIA 1. An inside diameter of zone 36 at the upper perimeter of body 16 is illustrated by an arrow DIA 7. The body 16 is generally a fully circular inverted bowl but may be one half, one quarter or other fraction of a fully circular inverted bowl. A numerical example of dimensions in inches for the body 16 is provided for illustrative purposes as follows with the value given for the origin of the radius of each frustro-toroidal zone representing a lateral offset from axis 14.

DIA 1=15.500
zone 24 V1=2.500, A=85°
zone 26 V2=3.120, R2=16.340, OR2=8.740
zone 28 V3=1.470, B=70°
zone 30 V=1.538, R4=5.330, OR4=1.390
zone 32 V5=0.625, R5=4.330, OR5=1.880
zone 34 V6=1.035, R6=2,810, OR6=2.160
zone 36 V7=0.450, R7=3.310, OR7=2.160
DIA 7=6.300 and V=10.738.

Figure 5:
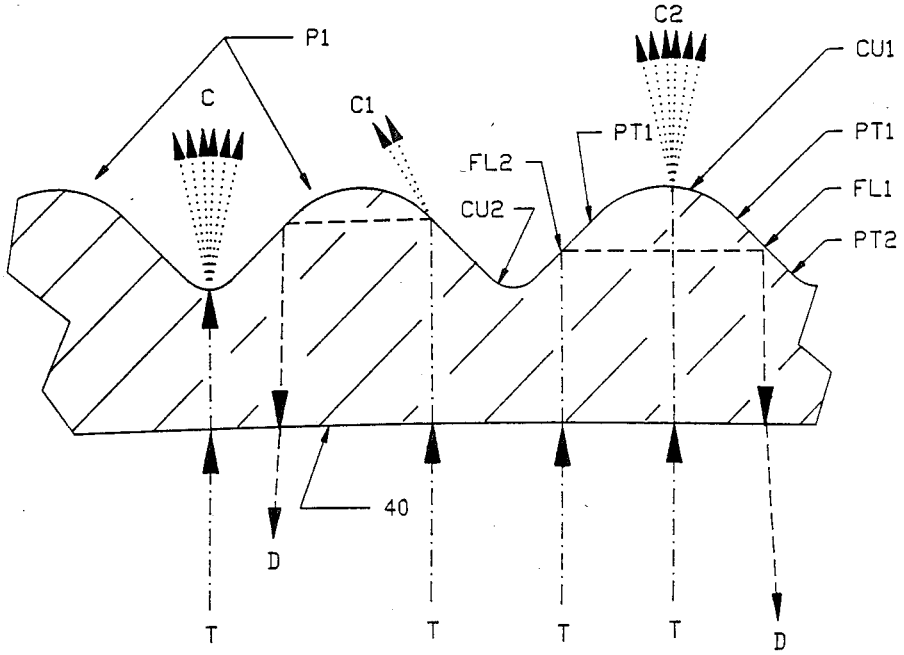
FIG. 5 is a fragmentary cross-sectional view taken along the line 5—5 of FIG. 2.
Figure 8:
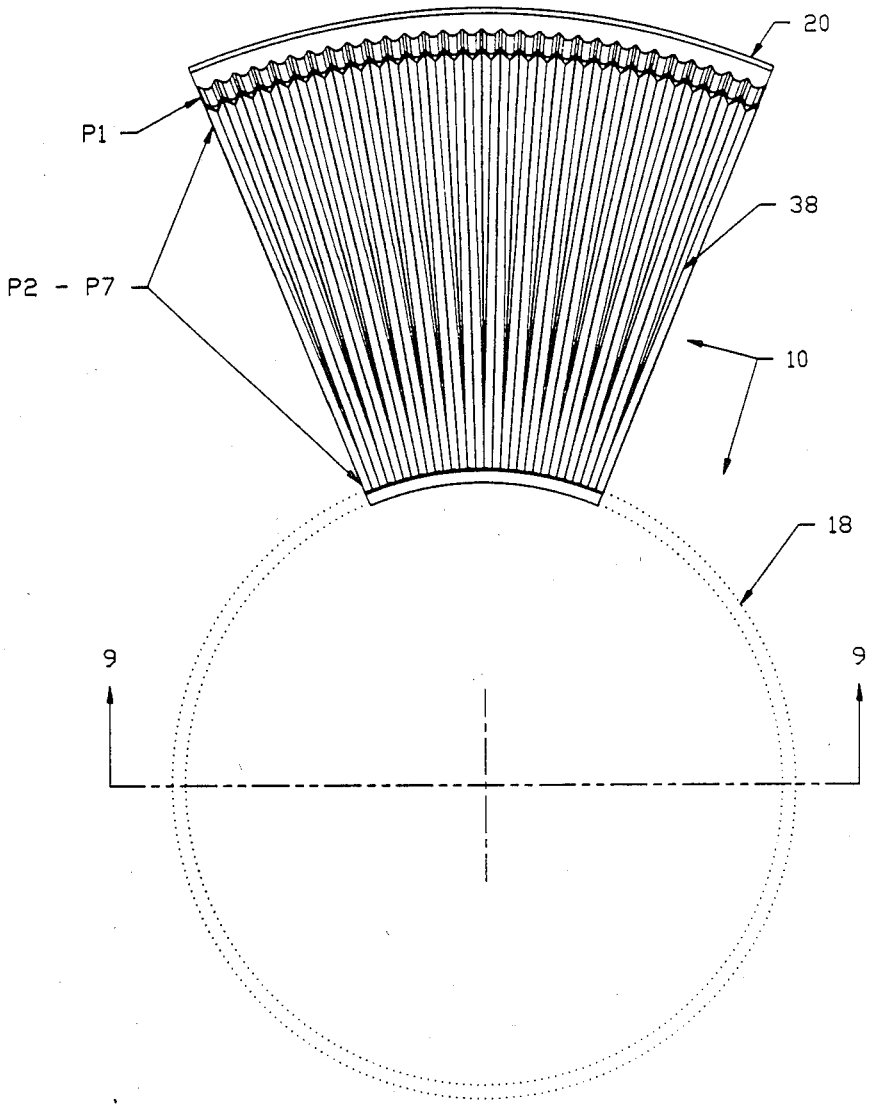
FIG. 8 is an enlarged fragmentary top plan view of the reflector/refractor device of FIG. 1.
Figure 8A:
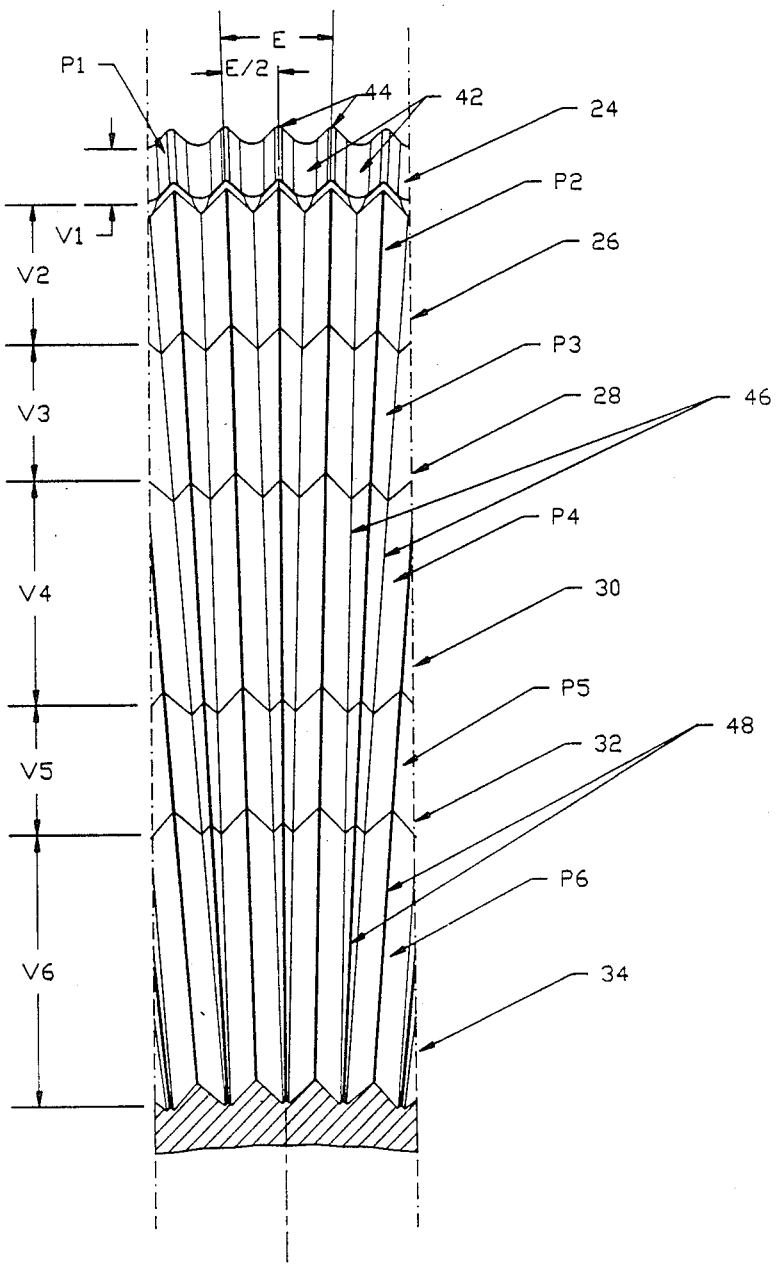
FIG. 8A is a fragmentary portion of FIG. 8 to illustrate elements of the reflector/refractor of FIG. 1.
Figure 9:
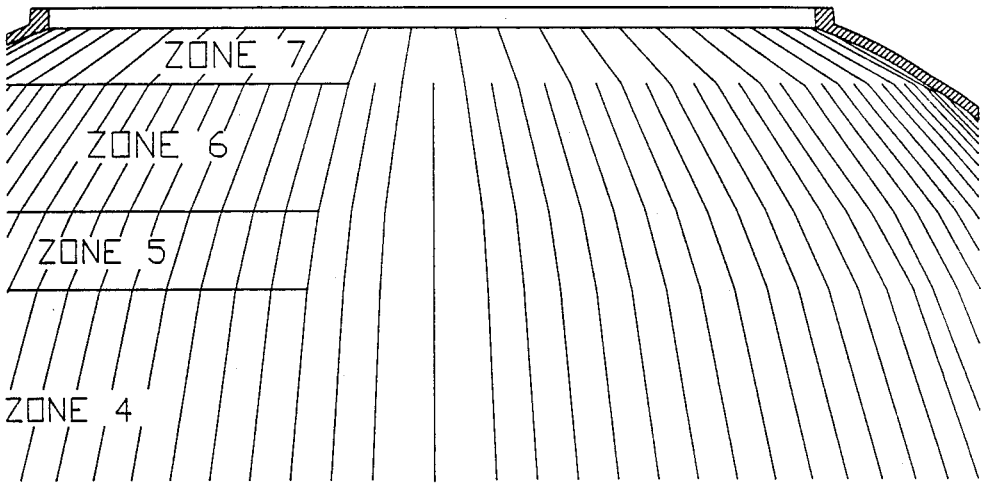
FIG. 9 is a fragmentary cross-sectional view taken substantially along the line 9—9 of FIG. 8.

Referring now to FIGS. 8 and 8A, an outside surface 38 of the body 16 is formed with a plurality of reflective/refractive prism elements designated generally as P1, P2, P3, P4, P5, P6 and P7 in each of the respective zones 24, 26, 28, 30, 32, 34 and 36. The prism elements P1, P2, P3, P4, P5, and P6 are best shown in FIG. 8A. An angle indicated by an (arrow) E defines the spacing of prism elements formed around the outside surface 38 in each zone, such as, for example where E=3°, 240 full prism elements are formed in zone 24 while only 120 full prism elements are formed in zone 36; alternate prism elements having gradually reduced and, finally, ended during the transition. Referring also to FIG. 5, prism elements P1 of sectional zones 24 are shown. An inside surface 40 of the body 16 in section zone 24 is a highly polished smooth, light receiving surface. Prism elements P1 consist of calculated curved and angled surfaces such that internal rays impinging thereon will be reflected or refracted as the incident angle is greater than or less than the critical angle of the transparent material (42.2 degrees for acrylic). The prism configuration used in this embodiment consists of flats FL1 and FL2 joined by curve CU1 at point of tangency PT1 and joining adjacent prisms by curve CU2 at point of tangency PT2. Herein the flats FL1 and FL2 remain at a constant included angle of 91° 8′ 28″ but the length of the flat diminishes as the prism becomes smaller toward its upper limit. The curve CU1 is here shown as a radius which will have a diminishing radius as the prism becomes smaller as it is defined by being tangent to the two flats at their endpoints. A parabolic CU1 would offer slightly more uniform refracted rays but is more difficult to achieve as the rate of curvature (or the focal length) of the parabola must also vary between the larger lower limit prism section and the smaller upper limit prism section. Curve CU2 is a modified parabola with fastest rate of curvature occurring at the junctions with the adjacent prisms. Again its rate of curvature also increases as prism size decreases. The length of the flats establishes the percentage of ray traces that will always be reflected regardless of vertical displacement of the light emitting means.

Figure 4:
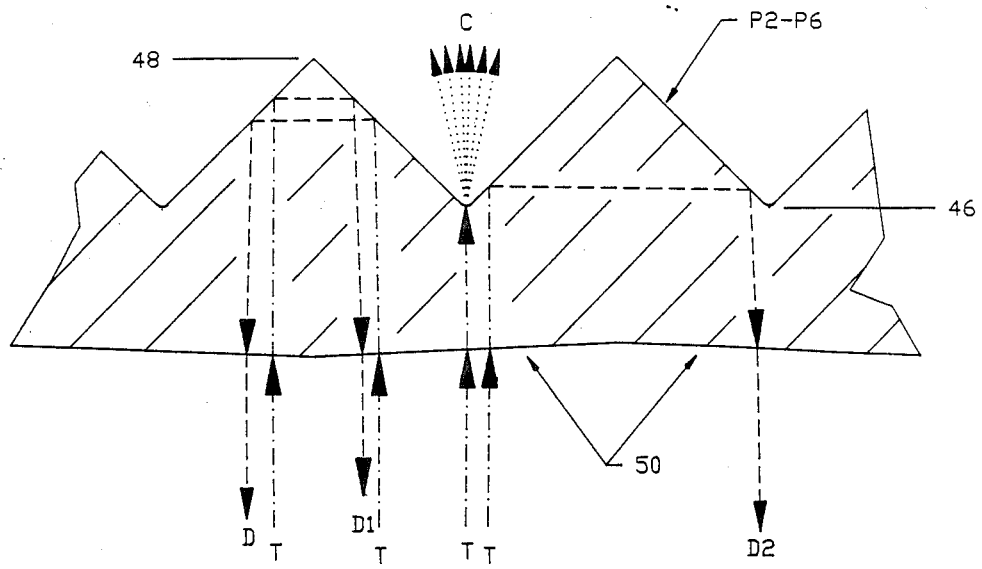
FIG. 4 is a fragmentary cross-sectional view taken along the lines 4—4 of FIG. 2.

Prism elements P2–P6 are best shown in FIGS. 4 and 8A, having a base indicated by a line 46 and projecting outwardly to an apex 48, being substantially conventional reflecting prisms at an angle such that the angle of incidence of all internal rays will exceed the critical angle of the transparent material, except only wherein the apex or vertex of the angled surfaces is curved to permit slight refraction, as desired. The included angle in this example is 91 degrees 8′ 28″. In general, the prisms P2–P6 have included angles of greater than 87° but less than 89° 30′ or included angles of greater than 90° 30′ but less than 93°. Referring to FIG. 4, an inside surface consists of a plurality of substantially vertical prisms 50 having lateral angles of greater than 0° 30′ but less than 2° 30′.

Each of the sectional zones 24, 26, 28, 30, 32 and 34 have predetermined light distribution characteristics for reflecting and refracting light. The light distribution characteristics of each sectional zone is determined by the corresponding prism optical configuration and the overall prism layout P2–P6 and the sectional zone position within the bowl-shaped body 16. The predetermined light distribution characteristics for sectional zone 24 and 36 are selectively variable by a vertical movement of the illuminating light source 12 which increases or decreases the incident angle to the inner surface 40, in turn, increasing or decreasing the internal incident angle to prism element P1 and, in turn, exceeding or falling within the critical angle of the transparent material and therefore reflecting or transmitting, through refraction, the individual ray.

The unitary body 16preferably is formed of a light transmitting synthetic resin material, such as, for example, an acrylic UVA5 or similar material. The body 16 preferably is formed by an injection molding technique. The precise control over tip and valley radii of prisms provided by the injection molding process permits the use of small-sized prism elements with essentially no losses due to undesired, non-controlled surfaces.

FIGS. 4 provides cross-section views through sectional zones 2–6 of the reflector/refractor 10. Referring to FIG. 4, prism elements P2–P6 include prism surfaces for internal reflection of light rays indicated as D, D1 and D2, with slight refraction indicated as C.

FIG. 5 provides a cross-section view through sectional zone 1 of the reflector/refractor 10. Referring to FIG. 5, prism elements P1 include prism surfaces which refract and reflect, more specifically; prisms elements P1 refract a substantially equal or greater quantity of light rays than they reflect as indicated by light components C, C1, C2, and D; the ratio depending upon the vertical placement of the light source 12. The effect of the prism elements P7 in zone 7 is identical to and compliments the effects of prism elements P1 in zone 1 as the light source 12 is vertically displaced.

Figure 6:
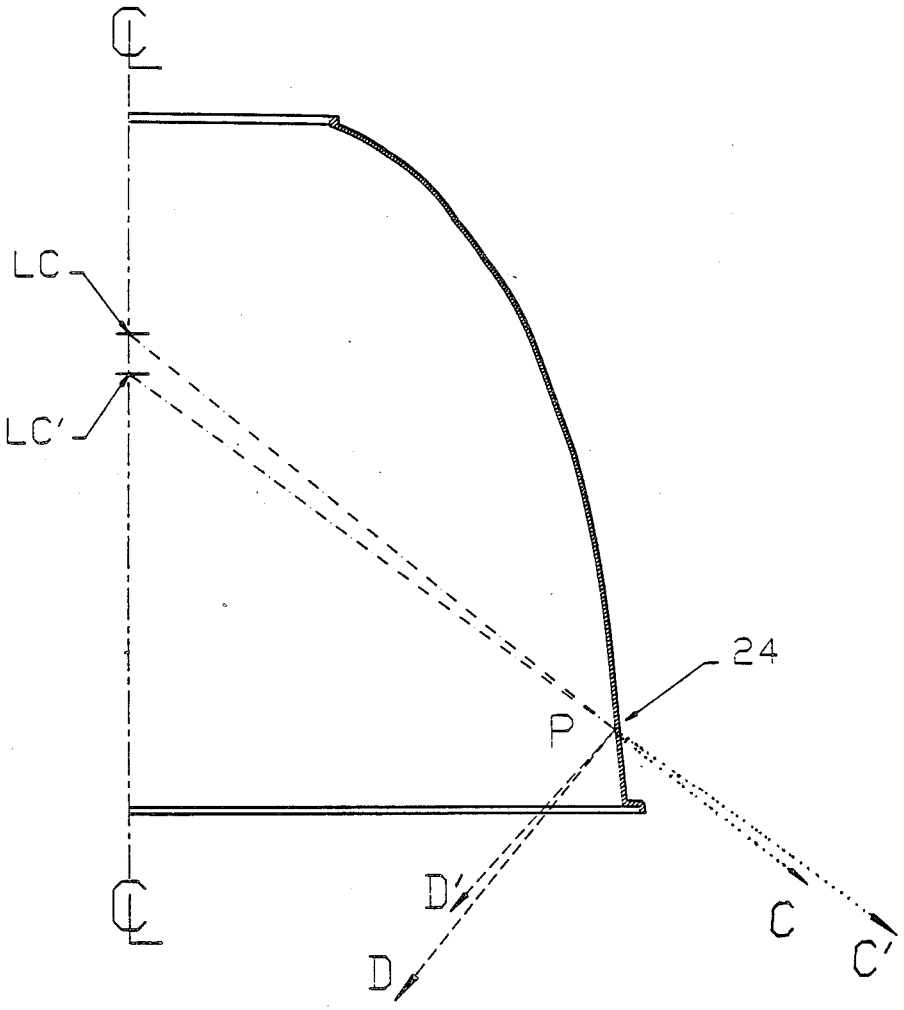
FIG. 6 is a graphical representation to illustrate the change in the light distribution characteristics of a first zone of the reflector/refractor device of FIG. 1, responsive to a vertical movement of a lamp source.

Referring now to FIG. 6, a first light path trace is shown extending from the center point LC of the lamp 12 to a point P within sectional zone 24 of the reflector/refractor 10 providing a refracted component C and a slightly greater reflected component D. The lamp 12 is moved downwardly to provide a lower light center point LC' with the corresponding light path shown in a dotted line running at an increased elevational angle and results in a refracted component C' indicating an increase in magnitude and elevational angle over the original light component C. Note also an increased elevational angle of reflected component D' combined with a decrease in magnitude from original light component D. The increased refracted component is sharply laterally displaced thereby significantly reducing apparent brightness. Further displacement of the light source, in either direction, will increase these effects. The effect of raising the light source is significantly further enhanced by increased first surface reflection of the smooth inner surface 40 of the body 16 in this zone (24).

In applications involving lower fixture mounting heights, the lowering of the light source position within the fixture will; 1) increase the vertical angle and intensity of refracted light rays, 2) diffuse the light source by lateral spreading of those rays and, 3) increase the angle but decrease the intensity of the reflected light rays. The converse is equally true and desirable.

In the particular example of the invention herein described, zones 1 and 7 are of the type such that a vertical displacement of the light source 12 will not only change the vertical angles of the emitted rays (whether refracted or reflected) but also change the relative proportions that are either refracted or reflected and, when refracted, also change the lateral angles of those emitted rays. Zones 2 through 6 are arranged such that the major output change resulting from a vertical displacement of the lamp 12 is the change in the vertical angle of the emitted rays. Various similar devices could be constructed with lesser or greater numbers of each type of zone and remain within the scope of the invention.

The reflector/refractor 10 advantageously is used with a lighting fixture with a vertical adjustment provision for the particular light source 12 and an integral, attached or separate instruction provides a summary of vertical position/light distribution results. Also the reflector/refractor 10 is used with a light fixture that presets the light source 12 to a fixed vertical position to enable a single optimized light distribution.

Although the present invention has been described in connection with details of the preferred embodiments, any alterations and modifications may be made without departing from the invention. Accordingly, it is intended that all such alterations and modifications be considered as within the spirit and scope of the invention as defined in the appended claims.

What is claimed and desired to be secured by Letters Patent is:

1. A reflector/refractor device used with a lighting fixture comprising:

a body having a predetermined profile, said body having an outside surface and an inside surface and defining a cavity;

illuminating means for emitting light disposed within said cavity substantially along a central vertical axis of said body; and said body including a series of sectional zones defining said predetermined profile for selectively providing a variable predetermined light distribution pattern determined by a vertical location of said illuminating means, said sectional zones including;

one or more zones having a plurality of substantially vertical prism means formed on said outside surface for reflecting a first portion of the emitted light substantially unaffected by the vertical location of said illuminating means;

at least one sectional zone including a plurality of prism means for selectively varying component proportions of refracted and reflected light portions responsive to a change in an incident angle of the emitted light, said incident angle being selectively variable by the vertical location of said illuminating means, said refracted light component portion having an increased magnitude responsive to a decreased incident angle of the emitted light and said reflected light component portion having a decreased magnitude responsive to a decreased incident angle of the emitted light.

2. A reflector/refractor device as recited in claim 1 wherein said predetermined profile of said body is generally bowl shaped; said at least one sectional zone for selectively varying component proportions of refracted and reflected light portions is defined by a substantially frustro-conical segment disposed adjacent an enlarged end of said bowl shaped profile, and said inside surface of said frustro-conical segment is substantially smooth.

3. A reflector/refractor device as recited in claim 1 wherein a first portion of said plurality of substantially vertical prism means has included angles of greater than 87° but less than 89° 30′ or included angles of greater than 90° 30′ but less than 93°; said first portion of substantially vertical prism means adapted for substantially greater reflecting than refracting.

4. A reflector/refractor device as recited in claim 1 wherein a second portion of said plurality of substantially vertical prism means has included angles of greater than 87° but less than 89° 30′ or included angles of greater than 90° 30′ but less than 93° in combination with significant curved portions near an apex of each prism, second portion of said plurality of substantially vertical prism means provided within said at least one sectional zone for selectively varying component proportions of said refracted and reflected light portions and adapted for substantially equal or greater refracting than reflecting.

5. A reflector/refractor device as recited in claim 3 wherein a portion of said inside surface of said body includes a plurality of substantially vertical prisms having lateral angles of greater than 0° 30′ but less than 2° 30′; wherein said inside portion is opposite said first portion of substantially vertical prism means.

6. A reflector/refractor device as recited in claim 1 wherein said body is a unitary member formed of a substantially transparent material.

7. A reflector/refractor device as recited in claim 1 wherein said body is a unitary member formed of a light transmitting synthetic resin material.

8. A reflector/refractor device as recited in claim 1 wherein said outside surface is formed with a plurality of both reflective and refractive elements.

9. A reflector/refractor device as recited in claim 1 wherein said series of sectional zones include at least one frustro-conical segment.

10. A reflector/refractor device as recited in claim 1 wherein said series of sectional zones include at least one frustro-toroidal segment.

11. A reflector/refractor device as recited in claim 2 wherein said series of sectional zones includes a plurality of frustro-toroidal segments and at least one frustro-conical segment.

12. A reflector/refractor device as recited in claim 2 wherein said bowl shaped profile is inverted and said series of sectional zones includes at least one upper frustro-toroidal segment and at least one lower frustro-conical segment.

13. A reflector/refractor device as recited in claim 2 wherein said bowl shaped profile is inverted and said series of sectional zones includes a plurality of upper frustro-toroidal segments, a frustro-conical segment, a frustro-toroidal segment and a lower frustro-conical segment.

14. A reflector/refractor device as recited in claim 1 wherein said body is formed by an injection molding technique.

15. A reflector/refractor device used with a lighting fixture comprising:

a body having a predetermined generally bowl shaped profile, said body having an outside surface and an inside surface and defining a cavity;

illuminating means for emitting light disposed within said cavity substantially along a central vertical axis of said body; and said body including a series of sectional zones defining said predetermined profile for reflecting and refracting light, each of said sectional zones having predetermined light distribution characteristics, said predetermined light distribution characteristics of at least one of said sectional zones being selectively variable by a vertical movement of said illuminating means, said at least one sectional zone segment having a substantially smooth inside surface and including a plurality of substantially vertical prism means formed on the outside surface, said prism means configured for selectively varying component proportions of refracted and reflected light portions responsive to a change in an incident angle of the emitted light, said incident angle being selectively variable by the vertical movement of said illuminating means, said prism means configured for either refracting or reflecting light responsive to an incident angle of said emitted light less than or greater than a critical angle of said prism means and said prism means being responsive to a decreased incident angle of the emitted light for providing a first component refracted light portion having an increased magnitude and a second component reflected light portion having a decreased magnitude.

16. A reflector/refractor device as recited in claim 15 wherein said bowl shaped profile is inverted.

17. A reflector/refractor device as recited in claim 15 wherein said bowl shaped profile is inverted and said series of sectional zones includes a plurality of upper frustro-toroidal segments, a frustro-conical segment, a frustro-toroidal segment and a lower frustro-conical segment.

18. A reflector/refractor device as recited in claim 15 wherein said body is a unitary member formed of a light transmitting synthetic resin material.

19. A reflector/refractor device as recited in claim 18 wherein said body is formed by an injection molding technique.

20. A reflector/refractor device used with a lighting fixture comprising:

a body having a predetermined inverted bowl-shaped profile, said body having an outside surface and an inside surface and defining a cavity;

an illuminating lamp source disposed within said cavity substantially along a central vertical axis of said body; and said body including a series of sectional zones defining said predetermined profile for selectively providing a variable predetermined light distribution pattern determined by a vertical location of said illuminating means, a portion of said outside surface corresponding to at least one sectional zone formed with a plurality of substantially vertical prism elements, said vertical prism elements having included angles in a range between 87° and 89° 30′ or between 90° 30′ and 93°, said vertical prism elements within said at least one sectional zone including prism surface means for selectively varying both refracted and reflected light portions responsive to a change in an incident angle of the emitted light, said incident angle being selectively variable by the vertical location of said illuminating means, said prism means configured for either refracting or reflecting light responsive to an incident angle of said emitted light less than or greater than a critical angle of said prism means, said prism surface means providing a first refracted light portion having an increased magnitude responsive to a decreased incident angle of the emitted light and a second reflected light portion having a decreased magnitude responsive to a decreased incident angle of the emitted light, whereby said predetermined light distribution pattern is selectively determined by the vertical location of said illuminating means.

* * * * *